United States Patent [19]

Frangatos

[11] 4,077,892

[45] Mar. 7, 1978

[54] LUBRICANT COMPOSITION

[75] Inventor: Gerassimos Frangatos, Cherry Hill, N.J.

[73] Assignee: Mobil Oil Corporation, New York, N.Y.

[21] Appl. No.: 789,171

[22] Filed: Apr. 20, 1977

[51] Int. Cl.[2] ..... C10M 1/10; C10M 3/02; C10M 5/02; C10M 7/02

[52] U.S. Cl. ..... 252/49.9; 252/49.8

[58] Field of Search ..... 252/49.8, 49.9

[56] References Cited

U.S. PATENT DOCUMENTS

| | | | |
|---|---|---|---|
| 3,657,397 | 4/1972 | Brannen | 252/49.8 |
| 3,674,897 | 7/1972 | Lada et al. | 252/49.8 |
| 3,970,570 | 7/1976 | Pratt et al. | 252/49.9 |

FOREIGN PATENT DOCUMENTS

| | | | |
|---|---|---|---|
| 753,908 | 8/1956 | United Kingdom | 252/49.8 |

*Primary Examiner*—Delbert E. Gantz
*Assistant Examiner*—Irving Vaughn
*Attorney, Agent, or Firm*—Charles A. Huggett; Raymond W. Barclay; Claude E. Setliff

[57] ABSTRACT

The invention provides a lubricant composition having improved antiwear properties resulting from the addition thereto of a product made by reacting a partially esterified multifunctional alcohol with a phosphorus trihalide or a dihydrocarbyl phosphonate.

11 Claims, No Drawings

LUBRICANT COMPOSITION

BACKGROUND OF THE INVENTION

1. Field of the Invention

The invention relates to improving the antiwear and load carrying properties of a lubricant. More particularly, it is concerned with improving such properties by adding to the lubricant a small amount of a phosphorus-containing compound.

2. Description of the Prior Art

Lubricants are subject to heavy stresses that can affect their antiwear and load carrying ability. Thus, there has been considerable effort to discover classes of compounds that will aid in retaining or, preferably, in improving these important properties.

For example, sulfur compounds have been used for the purpose, as is taught in U.S. Pat. No. 3,697,499. Unfortunately, the presence of sulfur in lubricants may cause severe metal corrosion, especially copper. To overcome this, special processes have been used to moderate the effect of sulfur as in U.S. Pat. No. 3,697,499, or other materials have been used, among them certain phosphorus compounds as lubricant additives. U.S. Pat. No. 3,663,439, for instance, discloses lubricating oils where extreme pressure properties have been improved by adding thereto a reaction product involving a trihydrocarbyl phosphite.

SUMMARY OF THE INVENTION

In accordance with the invention there is provided a lubricant composition comprising lubricant and an antiwear or load carrying amount of a product made by reacting a partially esterified polyfunctional alcohol with a phosphorus trihalide, e.g., the trichloride or tribromide, or a dihydrocarbyl phosphonate.

DESCRIPTION OF SPECIFIC EMBODIMENTS

Due to the complex nature of the reaction that occurs between the partially esterified material and the phosphorus compounds specified, no precise structure can be applied to the reaction product. Thus, the final product will be referred to herein, both in the specification and claims, as a product of the specified reaction.

The partially esterified products useful in the practice of this invention are those prepared from polyhydric alcohols and mono-carboxylic acids. The polyhydric alcohols may contain from 2 to 20 carbon atoms and from 2 to 4 hydroxyl groups. Illustrative of the useful materials are (1) the trimethylols, such as the ethane, propane and butane derivatives, (2) 2,2-disubstituted propane diols and (3) pentaerythritols.

The acids used in the esterification reaction are the monocarboxylic acids containing from 4 to 20 carbon atoms. Preferably the acid is an aliphatic acid and more preferably one containing from 5 to 9 carbon atoms. Thus, the more preferred acids include the valeric, caproic, heptylic, caprylic and pelargonic acids and mixtures thereof.

The partially esterified products are prepared by reacting at least 1 mole of the acid with each mole of the polyfunctional alcohol, but less of the acid than would be stoichiometrically required to react with all hydroxyl functions. For instance, for a dihydric alcohol, one mole of acid would be required.

In general, the reaction can be carried out at from about 120° C to about 225° C, preferably from about 160° C to about 185° C. The temperature, of course, is selected in accordance with the alcohol and/or acid used. Times will vary also depending upon the reactants. These will vary from about 1 hour to about 6 hours and will preferably be from about 1 hour to about 2 hours. Solvents may be used if desired. When used, the solvent should be removed, so it should be selected not only for its ability to solubilize the reactants and the product of reaction, but also for its ease of separation from the reaction medium. When a solvent is not used, it is recommended that any insolubles be removed by filtration or other means.

In another aspect of the invention, the partially esterified product can be prepared by heating together a mixture of ester, i.e., the completely esterified product, and the alcohol used to prepare such ester. For example, such partial ester can be prepared by heating together a mixture of an ester made from pentaerythritol and a $C_5$–$C_9$ aliphatic monocarboxylic acid and pentaerythritol. For this reaction, a molar ratio of ester to alcohol of from 1:1 to 3:1 can be used. In carrying out the reaction it is advantageous to use a basic catalyst such as calcium hydroxide.

The reaction temperatures for this aspect will vary, ranging from about 150° C to about 225° C, preferably from about 200° C to about 225° C. Times to assure complete reaction between the ester and alcohol will range from about 1 hour to about 6 hours, preferably from about 2 hours to about 4 hours.

As has already been stated, the partially esterified product, obtained by either of the above methods, is reacted with a phosphorus trihalide, including phosphorus trichloride and tribromide, which are used in amounts stoichiometrically equivalent to the hydroxyl remaining in the partial ester. The presence of a base, such as tertiary amine, as an acid carrier is desirable, because without it the acid may cleave some of the —P—OR moieties to form free —P—OH groups. Nitrogen may also be sparged through the reaction mixture. Reaction temperatures will vary from about 0° C to about 75° C, preferably from about 25° C to about 75° C. The reaction is carried out until completion, usually requiring from about 10 minutes to about two hours, preferably from about 30 minutes to about 1 hour.

The dihydrocarbyl phosphonates reacted with the partially esterified product having the formula:

$$(RO)_2\overset{\overset{\displaystyle O}{\|}}{P}\text{—}H$$

where R may be the same or different and is hydrocarbyl group containing from 1 to 20 carbon atoms. The phosphonates wherein R is lower alkyl, i.e., an alkyl having from 1 to 6 carbon atoms, are preferred. The useful reactants include those phosphonates wherein R in the formula is methyl, ethyl, butyl or hexyl. Also included are those phosphonates wherein R is an aryl group, such as phenyl or naphthyl, an alkanyl group such as a phenyl group or a naphthyl group having a $C_1$–$C_{10}$ alkyl group attached thereto, or an aralkyl group such as a phenethyl group. This reactant is employed to the extent of from about 0.25 mole to about 3 moles thereof, preferably about 1 mole to about 2 moles, per mole of partially esterified product. The time reaction will vary from about one hour to about 6 hours, preferably about 2 hours to about 4 hours and will be conducted at a temperature within the range of from about 125° C to about 225° C, preferably about 180° C to about 200° C.

The lubricants which are improved by the reaction products of this invention are mineral and synthetic lubricating oils and greases therefrom. The mineral oils will be understood to include not only the paraffinic members, but also the naphthenic members. By synthetic oils are meant synthetic hydrocarbons, polyalkylene oxide oils, polyacetals, polysilicones and the like, as well as synthetic ester oils. Included among the latter type are those esters made from monohydric alcohols and polycarboxylic acids, such as 2-ethylhexylazelate and the like. Also included are those esters made form polyhydric alcohols and aliphatic monocarboxylic acids. Those of this group are especially important and in this group are found esters prepared from (1) the trimethylols, such as the ethane, propane and butane derivatives thereof, (2) 2,2-disubstituted propane diols and (3) the pentaerythritols reacted with aliphatic monocarboxylic acids containing from about 4 to 9 carbon atoms. Mixtures of these acids may be used to prepare the esters. Preferred among the esters are those made from pentaerythritol and a mixture of $C_5$–$C_9$ acids.

As has been indicated, the reaction products disclosed herein are useful as antiwear and load carrying agents. When so used, they may be added in amounts sufficient to impart such properties to the lubricant. More particularly, such properties will be imparted to the lubricant by adding from about 0.25% to about 10% by weight, preferably from about 1% to about 3%, of the product.

Having discussed the invention in broad and general terms, the following are offered to illustrate it. It is to be understood that the Examples are merely illustrative and are not intended to limit the scope of the invention.

EXAMPLE 1

A mixture of 20.4 g (9.15 mole) of pentaerythritol, 58.5 g (0.45 mole) of heptanoic acid and 150 ml of n-decane was stirred and refluxed for four hours. 8 ml of water was collected in a water trap. 30.3 g (0.3 mole) of triethylamine was added and the mixture was cooled. 13.7 g (0.1 mole) of phosphorus trichloride was added and the reaction mixture was heated at 70° for one hour. It was cooled and then filtered, after which the solvent was removed, leaving a residue of 62 g having a phosphorus content of 3.29% by weight.

EXAMPLE 2

A mixture of 360 g (0.6 mole) of pentaerythritol ester, 27.2 g (0.2 mole) of pentaerythritol and 0.5 g of calcium hydroxide was heated under nitrogen with stirring at 220°–225° C for 3 hours. The reaction mixture was cooled and 81.0 g (0.8 mole) of triethylamine was added thereto. 34.3 g (0.25 mole) of phosphorus trichloride was slowly added to the mixture with stirring and cooling. Following the addition of phosphorus trichloride the reaction mixture was brought to 80° C and maintained there for ½ hour. The mixture was filtered and the filtrate was heated to 110° C under reduced pressure to remove any remaining phosphorus trichloride. The residue weighed 352 g and had a phosphorus content of 2.89% by weight.

EXAMPLE 3

A mixture of 180.0 g (0.3 mole) of pentaerythritol ester, 27.2 g (0.2 mole) of pentaerythritol and 1.0 g of calcium hydroxide was heated at 220°–225° C for 3 hours. The reaction mixture was cooled to room temperature and 77.6 g (0.4 mole) of dibutyl phosphite, i.e., $$(C_4H_9O)_2\overset{\overset{\displaystyle O}{\|}}{P}-H$$

was added. This mixture was stirred at 190°–195° C for 2 hours, while stirring and bubbling nitrogen therethrough. Charcoal and a filter aid were added to the residue and it was filtered, leaving 247 g of product having a phosphorus content of 4.66% by weight.

The ester used in Examples 2 and 3 is obtained by reacting a mixture of $C_5$–$C_9$ monocarboxylic acid and pentaerythritol. Its viscosity at 210° F was about 5 centistokes. In addition it had a hydroxyl number of about 3.4 and a saponification No. of about 400.

EVALUATION OF PRODUCTS

The products of the Examples were tested in the 4-Ball Test using a modified 4-Ball machine. In this test, three stationary balls are placed in a lubricant cup and a lubricant containing the additive to be tested is added thereto. A fourth ball is placed on a chuck mounted on a device which can be used to spin the ball at known speeds and loads.

One percent by weight of each product was placed in a blend of a 150 inch (210° F) solvent paraffinic bright mineral oil and a 200 inch (100° F) solvent paraffinic neutral mineral oil. These were blended in a ratio of 80/20, respectively. The samples were tested at various temperatures and speeds, but always at a load of 60 Kg and for 30 minutes. The following table summarizes the test results.

TABLE 1

| Example 1 | Room Temperature | | | | 20° F | | | | 390° F | | | |
|---|---|---|---|---|---|---|---|---|---|---|---|---|
| RPM | 500 | 1000 | 1500 | 2000 | 500 | 1000 | 1500 | 2000 | 500 | 1000 | 1500 | 2000 |
| Average Scar Diameter* | | | | | | | | | | | | |
| Horizontal | 0.40 | 0.40 | 0.40 | 0.50 | 0.40 | 0.50 | 0.80 | 0.50 | 0.50 | 0.60 | 0.80 | 2.30 |
| Vertical | 0.40 | 0.40 | 0.40 | 0.50 | 0.40 | 0.50 | 0.80 | 0.50 | 0.50 | 0.60 | 0.80 | 2.37 |
| Example 2 | | | | | | | | | | | | |
| Average Scar Diameter* | | | | | | | | | | | | |
| Horizontal | 0.40 | 0.60 | 0.70 | 0.70 | 0.50 | 0.60 | 0.70 | 0.80 | 0.60 | 0.70 | 0.70 | 0.70 |
| Vertical | 0.40 | 0.60 | 0.70 | 0.70 | 0.50 | 0.60 | 0.70 | 0.80 | 0.60 | 0.70 | 0.70 | 0.70 |
| Example 3 | | | | | | | | | | | | |
| Average Scar Diameter* | | | | | | | | | | | | |
| Horizontal | 0.40 | 0.40 | 0.40 | 0.40 | 0.40 | 0.40 | 0.50 | 0.50 | 0.50 | 0.50 | 0.70 | 0.70 |
| Vertical | 0.40 | 0.40 | 0.40 | 0.40 | 0.40 | 0.40 | 0.50 | 0.50 | 0.50 | 0.50 | 0.70 | 0.70 |
| Untreated Oil | | | | | | | | | | | | |
| Average Scar Diameter* | | | | | | | | | | | | |

TABLE 1-continued

| Example 1 | Room Temperature | | | | 20° F | | | | 390° F | | | |
|---|---|---|---|---|---|---|---|---|---|---|---|---|
| RPM | 500 | 1000 | 1500 | 2000 | 500 | 1000 | 1500 | 2000 | 500 | 1000 | 1500 | 2000 |
| Final Average | 0.50 | 0.60 | 0.88 | 2.34 | 0.60 | 1.06 | 1.86 | 2.23 | 1.00 | 1.31 | 2.06 | 1.98 |

*In millimeters

I claim:

1. A lubricant composition comprising a major amount of a lubricant and a minor, antiwear or load carrying amount of a product made by reacting a partially esterified polyfunctional alcohol with a phosphorus trihalide or a dihydrocarbyl phosphonate.

2. The composition of claim 1 wherein the said partially esterified polyfunctional alcohol is prepared by reacting pentaerythritol and a $C_5$–$C_9$ aliphatic monocarboxylic acid.

3. The composition of claim 1 wherein the said partially esterified polyfunctional alcohol is prepared by reacting a pentaerythritol ester with pentaerythritol in the presence of a basic catalyst.

4. The composition of claim 3 wherein said basic catalyst is calcium hydroxide.

5. The composition of claim 1 wherein said alcohol is pentaerythritol.

6. The composition of claim 1 wherein said trihalide is trichloride.

7. The composition of claim 1 wherein said phosphonate has the formula:

$$(RO)_2\overset{\overset{\displaystyle O}{\|}}{P}-H$$

wherein R is a hydrocarbyl group containing 1 to 20 carbon atoms.

8. The composition of claim 7 wherein R is butyl.

9. The composition of claim 1 wherein said product is prepared by (1) reacting pentaerythritol with heptanoic acid and (2) reacting the material from (1) with phosphorus trichloride.

10. The composition of claim 3 wherein the product is obtained by reacting the partial ester with phosphorus trichloride.

11. The composition of claim 3 wherein the product is obtained by reacting the partial ester with dibutyl phosphite.

* * * * *